US007377865B2

(12) United States Patent
Bedwell et al.

(10) Patent No.: US 7,377,865 B2
(45) Date of Patent: May 27, 2008

(54) BOWED FIELD HOCKEY STICK

(75) Inventors: Katelyn Bedwell, Burlington, VT (US); Joanna Kotula, Baltimore, MD (US)

(73) Assignee: STX, LLC, Baltimore, MD (US)

( * ) Notice: Subject to any disclaimer, the term of this patent is extended or adjusted under 35 U.S.C. 154(b) by 0 days.

(21) Appl. No.: 11/600,821

(22) Filed: Nov. 17, 2006

(65) Prior Publication Data

US 2007/0129187 A1 Jun. 7, 2007

Related U.S. Application Data

(60) Provisional application No. 60/737,768, filed on Nov. 18, 2005.

(51) Int. Cl.
*A63B 59/12* (2006.01)

(52) U.S. Cl. ..... 473/560; 473/562

(58) Field of Classification Search ..... 473/560–563
See application file for complete search history.

(56) References Cited

U.S. PATENT DOCUMENTS 4,563,006 A 1/1986 Hollner
4,629,190 A * 12/1986 Borgen ..... 473/560
4,799,682 A * 1/1989 Hughes ..... 473/563
5,603,498 A * 2/1997 Crawford et al. ..... 473/563
5,853,338 A * 12/1998 Ubriaco ..... 473/562
2002/0065154 A1* 5/2002 Goldsmith et al. ..... 473/560
2006/0194656 A1* 8/2006 Bedwell et al. ..... 473/560

FOREIGN PATENT DOCUMENTS

CH 695480 A5 * 6/2006
DE 4415509 A1 * 11/1995
FR 2599983 A1 * 12/1987
FR 2610835 A1 * 8/1988
GB 2201117 8/1988
GB 2317117 A * 3/1998

* cited by examiner

*Primary Examiner*—Mark S Graham
(74) *Attorney, Agent, or Firm*—Paul, Hastings, Janofsky & Walker LLP

(57) ABSTRACT

The present invention provides a field hockey stick having a substantially straight grip portion and a bowed hitting portion. In one embodiment, a stick has a substantially straight handle, a bowed throat, and a bowed head. In another embodiment, a stick has a substantially straight handle and a bowed throat, with at least a portion of the playing surface of the head in substantially the same plane or line as the front face of the handle. In another embodiment, a stick has a substantially straight handle and a bowed throat, with the playing surface of the head set back from the plane or line of the front face of the handle.

7 Claims, 6 Drawing Sheets

BOWED FIELD HOCKEY STICK

This application claims priority to U.S. Provisional Application No. 60/737,768, filed Nov. 18, 2005, which is incorporated herein by reference in its entirety.

BACKGROUND

1. Field of the Invention

The present invention relates generally to field hockey sticks, and more particularly, to a field hockey stick having a substantially straight grip portion and a bowed hitting portion.

2. Background of the Invention

As shown in FIG. 1, a field hockey stick 100 typically has a handle 102, a throat 104, and a head 106. The handle 102 starts at the top and extends through to the throat 104. The handle 102 and throat 104 together define the shaft of the stick 100. The stick 100 curves at the base of the throat 104 to form the head 106. A horizontal line (such as line 115) drawn through the point at which stick 100 begins to curve marks the end of throat 104 and the beginning of head 106. The head 106 is also considered the base of the stick 100. The head 106 includes a toe 108 and curves horizontally and upwardly to form toe 108. The front (or left hand side, as shown in FIG. 1) of the stick 100 has a flat playing surface and the back is typically rounded and not playable in the game. The edges, disposed between the flat playing surface and the non-playing surface, are legal for play in the game. Generally, the flat playing surface (i.e., hitting portion) includes all of head 106 and at least a portion of throat 104. All sticks are suitable for "right handed" play.

Traditionally, field hockey sticks have been constructed of relatively standard dimensions, due primarily to widely accepted rules of the game. These rules dictate aspects of the stick such as weight, length, shape, and cross-section. For example, these rules can require that the lower part of the stick's left-hand (playing side) be smooth and flat, that the back of the stick (right-hand side or non-playing side) be smooth and rounded, that the stick weigh not more than 737 grams, and that every cross-section of the stick be able to pass through a two-inch ring. In meeting these rules, the traditional field hockey stick has typically featured a straight handle and straight hitting portion, a flat front face, and a curved back.

Recently, however, there has been a trend toward bowing or raking the entire length of a field hockey stick, from the end of the handle to the head. This bowing can enable players to increase the power with which they flick the ball, especially for shots on goal.

As players increase in skill level, they typically play lower to the ground and therefore can utilize more of the stick as a hitting surface, including the full hitting area of the stick from the end of the grip to the head. For example, in using full-length bowed sticks for push passes, a player typically sweeps the stick from a squatting position, causing the ball to travel down the stick and to whip off of the stick at a location near the head. However, because the full-length bow also shifts the hands behind the head, the full-length bowed sticks can impart an undesirable loft to the ball, especially as the bow increases the power of the shot. The setback position of the hands can also inhibit a player's feel for the ball during cradling and dribbling.

SUMMARY OF THE INVENTION

An embodiment of the present invention provides a field hockey stick having a substantially straight grip portion and a bowed hitting portion. In one embodiment, a stick has a substantially straight handle, a bowed throat, and a bowed head. In another embodiment, a stick has a substantially straight handle and a bowed throat, with at least a portion of the playing surface of the head in substantially the same plane as the front face of the handle. In another embodiment, a stick has a substantially straight handle and a bowed throat, with the playing surface of the head set back from the plane of the front face of the handle.

In comparison to conventional full-length bowed field hockey sticks, the field hockey stick of the present invention increases the whipping action of the stick and the resultant speed of the ball, while also improving ball control and minimizing loft. These performance benefits are especially apparent for skills such as dribbling or executing push passes.

DETAILED DESCRIPTION OF THE INVENTION

Figure 1:
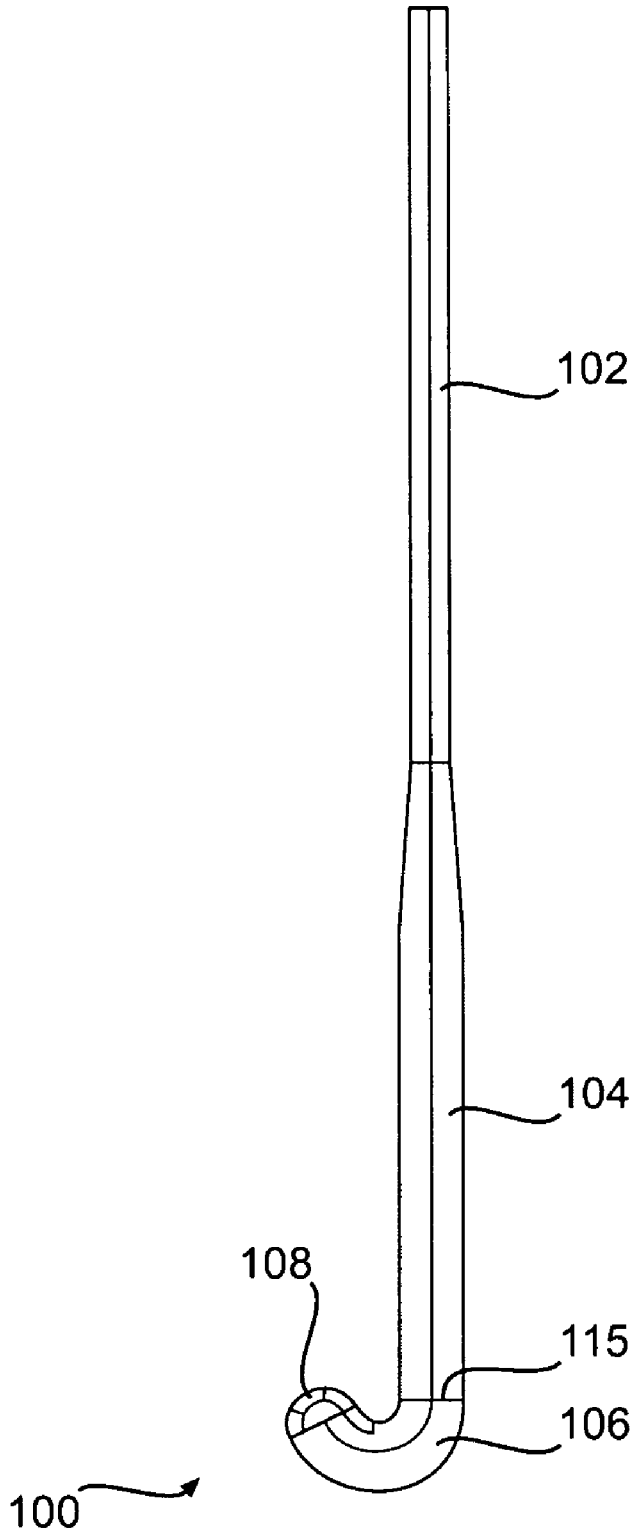
FIG. 1 is a schematic diagram of a conventional field hockey stick.
Figure 2:
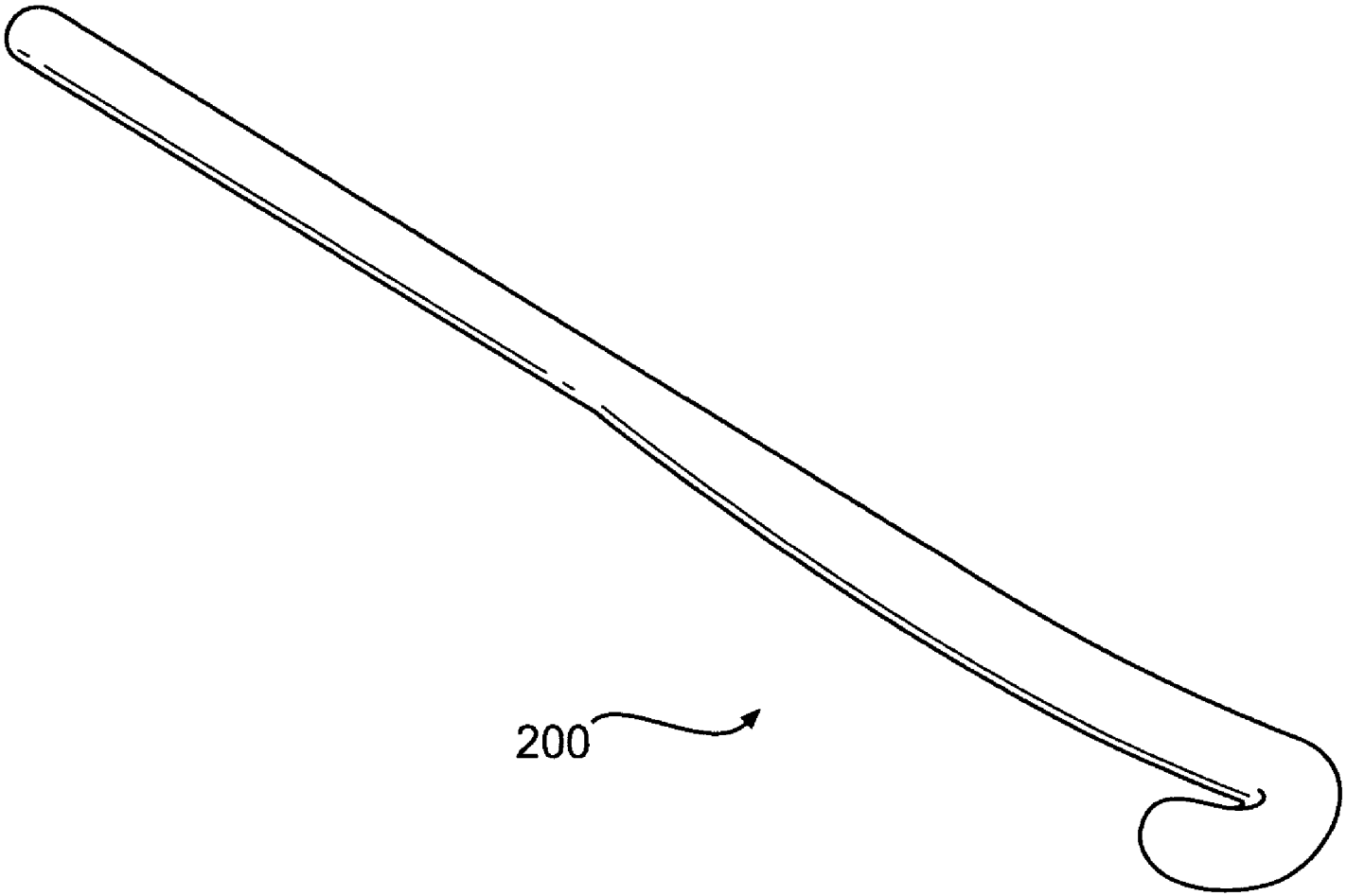
FIG. 2 is a schematic diagram of an isometric view of the playing side of an exemplary field hockey stick having a substantially straight handle and a bowed throat, with at least a portion of the playing surface of the head in substantially the same plane as the front face of the handle, according to an embodiment of the present invention.
Figure 3:
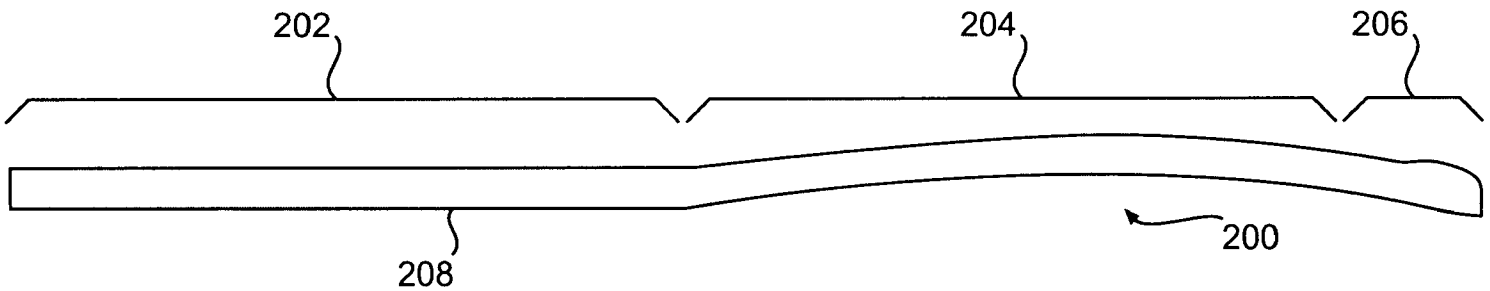
FIG. 3 is a schematic diagram of the back edge of the field hockey stick shown in FIG. 2.
Figure 4:
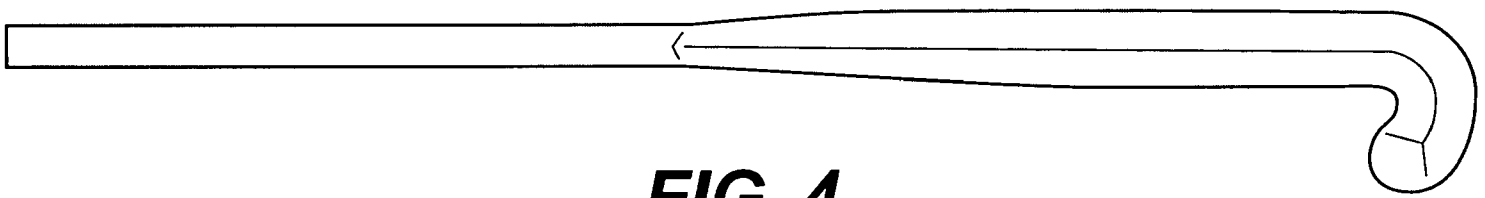
FIG. 4 is a schematic diagram of the playing side of the field hockey stick shown in FIG. 2.
Figure 5:
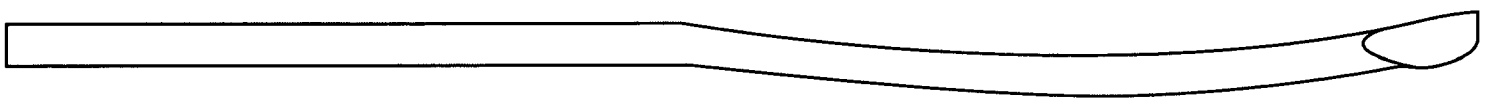
FIG. 5 is a schematic diagram of the front edge of the field hockey stick shown in FIG. 2.

FIGS. 2-5 illustrate an exemplary field hockey stick 200 comprising a handle 202, a throat 204 adjacent to the handle 202, and a head 206 adjacent to the throat 204 on a side of the throat 204 opposite to the handle 202, according to an embodiment of the present invention. Handle 202 is substantially straight and throat 204 is bowed. At least a portion of the playing surface of the head 206 is in substantially the same plane as the front face 208 of the handle 202. FIGS. 3 and 5 best show the relative positions of the handle 202, throat 204, and head 206.

As shown in this embodiment, the hitting portion of the stick 200, comprised of the throat 204 and head 206, is bowed toward the non-playing side of the stick 200. The bow begins at a location proximate to the handle 202, reaches a maximum setback approximately halfway between the start of throat 204 (or the end of the handle 202) and the end of head 206, and returns such that at least a portion of head 206 is in substantially the same plane as the front face 208 of the handle 202. In this example, the bow continues through the head 206. Accordingly, when the field hockey stick is viewed from a direction facing the front edge (FIG. 5), the playing side of the handle portion 202 lies substantially along a line and the bowed hitting portion bows away from the line in a direction toward the non-playing side of the field hockey stick. In the embodiment shown in FIGS. 2-5, the head portion 206 is bowed along with the throat 204 and has at least a portion lying in the aforementioned line.

In other embodiments, the bowed head 206 may extend across the aforementioned line such that at least a portion of the head 206 is in front of the front edge 208 of the field hockey stick. In still other embodiments, a top portion of the head 206 proximate to the throat 204 may be further frontward than a portion of the head 206 proximate to the end or bottom of the hockey stick 200. All or a portion of the head 206 in such embodiments may lie on the aforementioned line, be set back from the line, or be in front of the line. In this manner, the head 206 can be angled with respect to the aforementioned line, for example, to reduce or increase ball loft, as desired.

In an exemplary implementation of the invention, the maximum depth of the bow is approximately 25 mm. The maximum bow depth is measured as the shortest distance between a line in which the front edge of the handle portion lies to the front edge of the bowed hitting portion at its deepest location. Such a measurement in practice may be made by placing the field hockey stick on a tabletop or other flat surface with the playing side of the stick facing down. The maximum bow depth may then be measured as the largest distance the playing side surface is from the tabletop. As a skilled artisan would appreciate, however, the depth and shape of the bow could vary depending upon desired performance characteristics.

Figure 6:
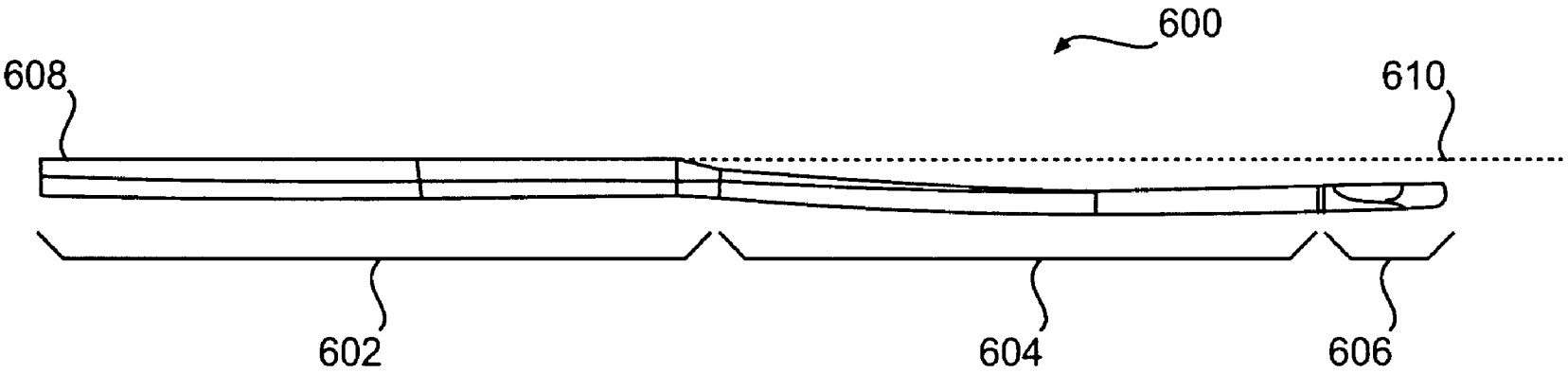
FIG. 6 is a schematic diagram of the front edge of an exemplary field hockey stick having a substantially straight handle and a bowed throat, with the playing surface of the head set back from the plane of the front face of the handle, according to an embodiment of the present invention.

FIG. 6 illustrates an exemplary field hockey stick 600 having a substantially straight handle 602 and a bowed throat 604, with the playing surface of the head 606 set back from the plane of the front face 608 of the handle 606, according to another embodiment of the present invention. In this embodiment, the hitting portion of the stick 600, comprised of the throat 604 and head 606, is bowed toward the non-playing side of the stick 600. The bow begins at a location proximate to the handle 602, reaches a maximum setback approximately halfway between the start of throat 604 and the end of head 606, and remains at a set back position such that the head 606 is set back from the plane of the front face 608 of the handle 602. The plane of the front face 608 is represented by the dashed line 610 in FIG. 6. Line 610 also represents the line in which the playing side of the handle portion 602 lies when viewed from a direction facing the front edge of the hockey stick 600. Accordingly, the bowed hitting portion including the throat 604 and the head 606 is set back or offset from the line 610.

Figure 7:
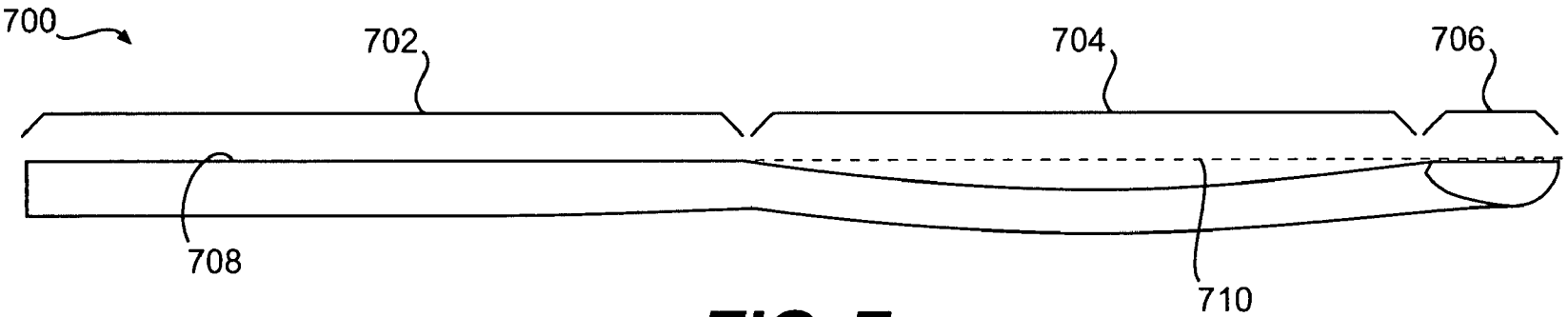
FIG. 7 is a schematic diagram of the front edge of an exemplary field hockey stick having a substantially straight handle and a bowed throat, with the playing surface of the head being generally flat and in substantially the same plane as the front face of the handle, according to an embodiment of the present invention.

FIG. 7 illustrates an exemplary field hockey stick 700 having a handle portion 702, a throat 704, and a head portion 706. In this embodiment, the bowed hitting portion including the throat 704 stops at the top of the head 706 such that substantially the full face or playing surface of the head 706 is flat and in the same plane as the front face of the handle 702. In other words, when viewed from a direction facing the front edge of the hockey stick, the playing side 708 of the handle portion 702 lies substantially along a line 710. In the embodiment shown in FIG. 7, the flat face of the head 706 also lies substantially on the line 710.

Figure 8:
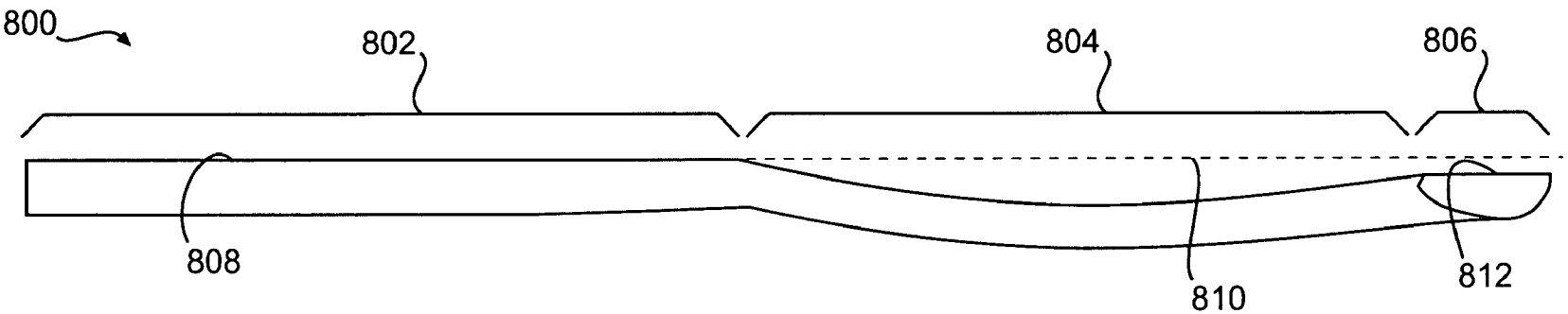
FIG. 8 is a schematic diagram of the front edge of an exemplary field hockey stick having a substantially straight handle and a bowed throat, with the playing surface of the head being generally flat and parallel to the plane of the front face of the handle, according to an embodiment of the present invention.

In another embodiment, shown in FIG. 8, a field hockey stick 800 may include a handle portion 802, a throat 804, and a head portion 806. In this embodiment, as in the embodiment of FIG. 7, the playing surface 812 of the head 806 is substantially flat. In FIG. 8, however, the head 806 is set back or offset from a line 810 in which the playing side of the handle portion lies when viewed from a direction facing the front edge 808 of the field hockey stick. That is, the head 806 is set back from a line 810 or the plane of the front face of the handle 802. The flat front face 812 of the head 806 may be parallel or substantially parallel to the line 810 or the plane of the front face of the handle 802. Alternatively, the front face of head 806 may be angled with respect to line 810 to accommodate a desired loft, as described above.

Figure 9:
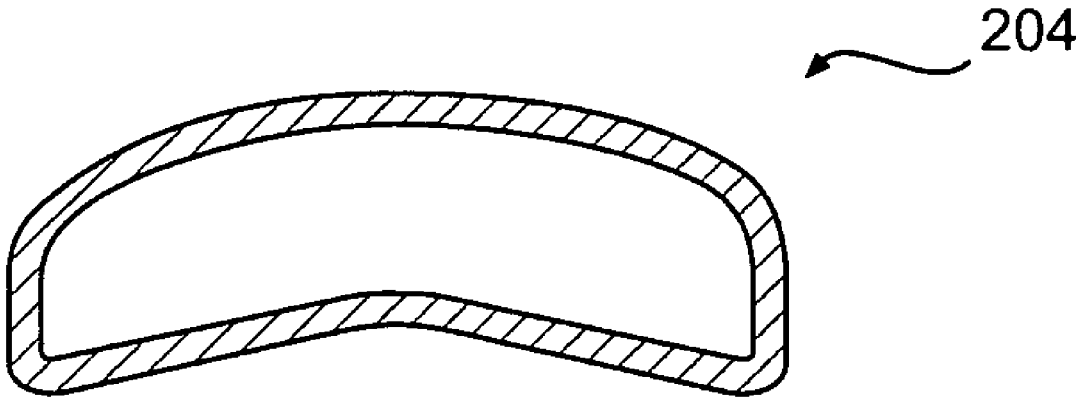
FIG. 9 is a schematic cross-sectional view of a hitting portion of an exemplary field hockey stick having a V-shaped channel on a playing side, according to an embodiment of the present invention.

FIG. 9 is a cross-sectional view of a hitting portion of a field hockey stick according to an embodiment of the present invention. A portion of a throat 204 is shown having a generally V-shaped playing side surface (downward facing surface in FIG. 9), or channel, and a generally rounded non-playing side surface (upward facing surface in FIG. 9). The V-shaped channel in accordance with the present invention reduces friction as compared to a curved playing surface by providing at most two contact points with a ball. By contrast, a curved playing surface may contact a ball along a continuous line or surface area, thereby increasing friction. The depth of the channel of the present invention may vary along the throat and may continue through the head portion 206. In another embodiment, the channel is only in the throat portion 204. The depth of the channel may, for example, be greatest in a region around the midpoint of the throat portion 204 and may decrease gradually as it moves toward the head 206 and/or toward the handle portion 202, though one of skill in the art would appreciate that the depth of the channel may be as varied or consistent as desired. In a preferred embodiment, the maximum depth of the channel is approximately 4 mm.

In providing a substantially straight handle and a bowed hitting portion, the present invention creates an offset between the grip portion of the stick and the hitting portion, so that a player's hands are more forward of most, if not all, of the hitting surface. In addition, in comparison to prior art sticks, the bow is more pronounced over a shorter distance, while still complying with widely accepted rules of field hockey stick construction (e.g., limiting the depth of the bow to 25 mm). The forwardly positioned hands and more pronounced bow in the hitting portion provide significant unexpected benefits over full-length bowed sticks. For example, having the hitting portion offset from the more forward grip allows a player to cradle the ball better when dribbling. The forward shift in hand placement also increases the power of drives and helps keep the ball from being lofted into the air. In addition, the forward position of the hand can increase the speed of a sweep or push pass off the bow because the ball can stay in contact with the stick longer and be subjected to an increased whip off the end of the stick.

The field hockey stick of the present invention can be made of, for example, wood or composites. As used herein, composites refer to field hockey sticks made by bladder molding or by wrapping sheets of uncured fiber-reinforced thermosetting resin around a mandrel, which is then withdrawn to form a hollow tubular lay-up. Examples of the materials used in the resin include fiberglass, carbon, and aramid. Composite sticks have been available on the market for several years and have been approved for use in international play.

The foregoing disclosure of embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims, and by their equivalents.

What is claimed is:

1. A field hockey stick comprising:

a substantially straight handle portion; and a bowed hitting portion;

a playing side;

a non-playing side;

a front edge; and a back edge, wherein, when viewed from a direction facing the front edge, a playing side of the handle portion lies substantially along a line, and wherein the bowed hitting portion bows away from the line in a direction toward the non-playing side of the field hockey stick, and wherein the bowed hitting portion comprises a throat portion, the field hockey stick further comprising a head portion having a substantially flat face that lies substantially along the line when viewed in a direction facing the front edge of the field hockey stick.

2. The field hockey stick of claim 1, wherein the bowed hitting portion reaches a maximum distance from the line at approximately half the length of the bowed hiding portion.

3. The field hockey stick of claim 2, wherein the maximum distance from the line is 25 mm.

4. The field hockey stick of claim 1, wherein the field hockey stick is hollow.

5. The field hockey stick of claim 1, wherein the bowed hiding portion comprises a playing side surface having a substantially V-shaped channel.

6. A field hockey stick comprising:

a substantially straight handle portion;

a throat portion; and a head portion, wherein, with respect to a perspective moving from the handle portion of the field hockey stick to the head portion of the field hockey stick, a portion of the throat portion proximate to the handle portion curves toward a non-playing side of the field hockey stick and a portion of the throat portion proximate to the head portion curves toward a playing side of the field hockey stick, wherein the head portion has a substantially fiat front face that is substantially coplanar with a front face of the handle portion.

7. The field hockey stick of claim 6, wherein the field hockey stick is hollow.

* * * * *